US008803652B2

(12) United States Patent
Kimura et al.

(10) Patent No.: US 8,803,652 B2
(45) Date of Patent: Aug. 12, 2014

(54) PROTECTION ELEMENT

(75) Inventors: Yuji Kimura, Nomi (JP); Takahiro Asada, Nomi (JP); Kazuaki Suzuki, Nomi (JP)

(73) Assignee: Dexerials Corporation, Tokyo (JP)

( * ) Notice: Subject to any disclaimer, the term of this patent is extended or adjusted under 35 U.S.C. 154(b) by 82 days.

(21) Appl. No.: 13/145,455

(22) PCT Filed: Jan. 14, 2010

(86) PCT No.: PCT/JP2010/050335

§ 371 (c)(1),
(2), (4) Date: Jul. 20, 2011

(87) PCT Pub. No.: WO2010/084818

PCT Pub. Date: Jul. 29, 2010

(65) Prior Publication Data

US 2012/0249283 A1 Oct. 4, 2012

(30) Foreign Application Priority Data

Jan. 21, 2009 (JP) ..... 2009-011197

(51) Int. Cl.

| | |
|---|---|
| ***H01H 37/76*** | (2006.01) |
| ***H01H 37/04*** | (2006.01) |
| ***H01H 85/20*** | (2006.01) |
| ***H01H 85/04*** | (2006.01) |

(52) U.S. Cl.

USPC ..... 337/186; 337/416; 337/297; 337/398; 29/623; 361/104

(58) Field of Classification Search

CPC ..... H01H 85/046; H01H 85/0411; H01H 85/0241; H01H 85/165; H01H 85/2045; H01H 85/0417; H01H 69/022; H01H 69/02; H01H 37/48; H01H 37/765; H02H 3/13; H02H 9/042

USPC ..... 337/416, 186, 398, 297; 29/623; 361/104

See application file for complete search history.

(56) References Cited

U.S. PATENT DOCUMENTS 2,171,864 A * 9/1939 Popp ..... 337/234
3,354,282 A 11/1967 Batsch (Continued)

FOREIGN PATENT DOCUMENTS

CN 1381935 A 11/2002
JP 08-7731 A 1/1996

(Continued)

OTHER PUBLICATIONS

U.S. Appl. No. 13/145,465; First Named Inventor: Yuji Kimura; Title: "Protection Element"; Filed: Jul. 20, 2011.

(Continued)

*Primary Examiner* — Bradley Thomas
(74) *Attorney, Agent, or Firm* — Holtz Holtz Goodman & Chick PC

(57) ABSTRACT

A protection element is provided which is capable of stably retaining a flux on a soluble conductor at a predetermined position, enabling a speedy and precise blowout of the soluble conductor in the event of an abnormality. This protection element includes: a soluble conductor 13 which is disposed on an insulation baseboard 11 and is connected to a power supply path of a device targeted to be protected, to cause a blowout by means of a predetermined abnormal electric power; a flux 19 which is coated onto a surface of the soluble conductor 13; and an insulation cover 14 which is mounted on the baseboard 11 with the soluble conductor 13 being covered therewith. In addition, the protection element is provided with a protrusive stripe portion 20 which is formed on an interior face of the insulation cover 14 in opposite to the soluble conductor 13 and in which a stepped portion 20*a* for retaining the flux 19 is formed at a predetermined position while in contact with the flux 19. The soluble conductor 13 has a hole portion 13*a* at which the flux 19 is retained.

6 Claims, 7 Drawing Sheets

(56) References Cited

U.S. PATENT DOCUMENTS

| | | | | |
|---|---|---|---|---|
| 3,386,063 | A * | 5/1968 | Mansfield, Jr. | 337/191 |
| 4,198,617 | A | 4/1980 | Hara | |
| 4,494,104 | A * | 1/1985 | Holmes | 337/403 |
| 4,893,106 | A * | 1/1990 | Goldstein et al. | 337/159 |
| 4,972,170 | A * | 11/1990 | Ehlmann et al. | 337/228 |
| 5,097,247 | A | 3/1992 | Doerrwaechter | |
| 5,252,942 | A * | 10/1993 | Gurevich | 337/163 |
| 5,270,679 | A * | 12/1993 | Gulbrandsen | 337/252 |
| 5,294,905 | A * | 3/1994 | Pimpis | 337/158 |
| 5,296,832 | A * | 3/1994 | Perreault et al. | 337/158 |
| 5,426,411 | A * | 6/1995 | Pimpis et al. | 337/186 |
| 5,497,286 | A * | 3/1996 | Shimada et al. | 361/105 |
| 5,631,621 | A | 5/1997 | Nakajima | |
| 5,659,284 | A | 8/1997 | Olofsson | |
| 5,712,610 | A * | 1/1998 | Takeichi et al. | 337/290 |
| 5,760,676 | A * | 6/1998 | Yamada | 338/22 R |
| 5,781,095 | A | 7/1998 | Dietsch et al. | |
| 5,821,849 | A * | 10/1998 | Dietsch et al. | 337/241 |
| 5,939,969 | A | 8/1999 | Doerrwaechter et al. | |
| 5,982,268 | A | 11/1999 | Kawanishi | |
| 5,994,993 | A * | 11/1999 | Castonguay et al. | 337/206 |
| 6,040,754 | A | 3/2000 | Kawanishi | |
| 6,169,472 | B1 * | 1/2001 | Kahr | 338/22 R |
| 6,198,376 | B1 | 3/2001 | Ishikawa et al. | |
| 6,222,438 | B1 | 4/2001 | Horibe et al. | |
| 6,300,859 | B1 | 10/2001 | Myong et al. | |
| 6,373,371 | B1 * | 4/2002 | Doerrwaechter et al. | 337/297 |
| 6,452,475 | B1 * | 9/2002 | Kawazu et al. | 337/290 |
| 6,456,189 | B1 * | 9/2002 | Mosesian et al. | 337/243 |
| 6,556,122 | B2 * | 4/2003 | Izaki et al. | 337/405 |
| 6,566,996 | B1 * | 5/2003 | Douglass et al. | 337/243 |
| 6,636,409 | B2 | 10/2003 | Kladar et al. | |
| 6,838,971 | B2 * | 1/2005 | Senda et al. | 337/296 |
| 7,042,327 | B2 * | 5/2006 | Tanaka et al. | 337/290 |
| 7,473,487 | B2 | 1/2009 | Senda et al. | |
| 7,535,332 | B2 | 5/2009 | Furuuchi et al. | |
| 7,718,308 | B2 * | 5/2010 | Senda et al. | 429/62 |
| 7,742,269 | B2 * | 6/2010 | Shinohara | 361/103 |
| 8,547,195 | B2 * | 10/2013 | Kimura et al. | 337/186 |
| 8,648,688 | B2 * | 2/2014 | Kimura et al. | 337/297 |
| 8,675,333 | B2 * | 3/2014 | Wang et al. | 361/103 |
| 2002/0014945 | A1 | 2/2002 | Furuuchi et al. | |
| 2002/0113685 | A1 | 8/2002 | Izaki et al. | |
| 2003/0156007 | A1 * | 8/2003 | Senda et al. | 337/401 |
| 2004/0070486 | A1 | 4/2004 | Senda et al. | |
| 2004/0085178 | A1 | 5/2004 | Tanaka et al. | |
| 2004/0100352 | A1 | 5/2004 | Tanaka | |
| 2004/0174243 | A1 | 9/2004 | Tanaka | |
| 2004/0196133 | A1 | 10/2004 | Kawanishi | |
| 2005/0001710 | A1 | 1/2005 | Mukai et al. | |
| 2005/0007233 | A1 | 1/2005 | Tanaka | |
| 2005/0035841 | A1 * | 2/2005 | Kobayashi et al. | 337/157 |
| 2005/0140491 | A1 * | 6/2005 | Uehara et al. | 337/401 |
| 2005/0264394 | A1 * | 12/2005 | Furuuchi | 337/182 |
| 2006/0028314 | A1 * | 2/2006 | Furuuchi | 337/4 |
| 2006/0097839 | A1 | 5/2006 | Tanaka | |
| 2006/0125594 | A1 * | 6/2006 | Furuuchi | 337/4 |
| 2007/0013472 | A1 * | 1/2007 | Kobayashi et al. | 337/159 |
| 2007/0024407 | A1 * | 2/2007 | Senda et al. | 337/159 |
| 2010/0085141 | A1 * | 4/2010 | Knab et al. | 337/227 |
| 2010/0109833 | A1 | 5/2010 | Knab et al. | |
| 2010/0245024 | A1 * | 9/2010 | Furuuchi et al. | 337/283 |
| 2011/0012704 | A1 * | 1/2011 | Kimura et al. | 337/168 |
| 2011/0181385 | A1 | 7/2011 | Schulze-Icking-Konert et al. | |
| 2011/0279219 | A1 | 11/2011 | Kimura et al. | |
| 2012/0001720 | A1 * | 1/2012 | Kimura et al. | 337/297 |
| 2012/0249283 | A1 * | 10/2012 | Kimura et al. | 337/416 |

FOREIGN PATENT DOCUMENTS

| | | | |
|---|---|---|---|
| JP | 2000-100290 | A | 4/2000 |
| JP | 2001-309551 | A | 11/2001 |
| JP | 2004-214032 | A | 7/2004 |
| JP | 2004-265617 | A | 9/2004 |
| JP | 2007-294117 | A | 11/2007 |

OTHER PUBLICATIONS

International Search Report (and English translation thereof) dated Feb. 9, 2010 in International Application No. PCT/JP2010/050335.

International Preliminary Report on Patentability (IPRP) dated Aug. 18, 2011 (and English translation thereof) in counterpart International Application No. PCT/JP2010/050335.

Chinese Office Action dated Apr. 3, 2013 (and English translation thereof) in counterpart Chinese Application No. 201080003219.7.

* cited by examiner

PROTECTION ELEMENT

TECHNICAL FIELD

The present invention relates to a protection element for, in case that an overcurrent or an overvoltage is applied to an electronic device or the like, allowing a soluble conductor to cause a blowout exerted by a heat of such an overcurrent or overvoltage and then to shut off a current.

BACKGROUND ART

Conventionally, a protection element which is mounted on a secondary battery device or the like is employed as the one that has a function of preventing an overvoltage as well as an overcurrent. This protection element is formed so that: a heating element and a soluble conductor made of a low-melting metal member are laminated on a board; the soluble conductor is blown out due to an overcurrent; and in case that an overvoltage is generated as well, power is supplied to the heating element in the protection element and then the soluble conductor is blown out due to a heat of the heating element. Blowout of the soluble conductor takes place due to goodness of wettability relative to a surface of a connected electrode at the time of blowout of the soluble conductor that is a low-melting metal. The low-melting metal that has been blown out is attracted onto an electrode, and as a result, the soluble conductor is broken and then a current is shut off.

On the other hand, with downsizing of an electronic device, such as a portable device, in recent years, there has been a need for downsizing or thinning a protection element of this type; and there has been a further demand for operational stability and fastness. As a means therefor, there is provided the one in which a soluble conductor of a low-melting metal member is disposed on an insulation board; the thus disposed soluble conductor is sealed with an insulation cover; and a flux is coated onto the soluble conductor. This flux is adapted to prevent oxidization of a surface of the soluble conductor, and is provided so that the soluble conductor blows out speedily and stably at the time of heating the soluble conductor.

Such a protection element has a structure shown in FIG. 13. In this protection element, a pair of electrodes 2 is provided on a baseboard 1, and a pair of electrodes, although not shown, is provided at an opposite edge part which is orthogonal to the electrodes 2 as well. A heating element 5 made of a resistor is provided between electrodes, although not shown, and a conductor layer 7 which is connected to one of the pair of electrodes, although not shown, via an insulation layer 6, is provided. At this protection element, a soluble conductor 3 made of a low-melting metal foil is provided between the pair of electrodes 2 that is formed on both ends of the baseboard 1. A center part of the soluble conductor 3 is provided on the conductor layer 7. Further, an insulation cover 4 is provided in face-to-face opposite to the soluble conductor 3 that is provided on the baseboard 1. The insulation cover 4 which is mounted on the baseboard 1 is put with a predetermined space 8 being formed relative to the soluble conductor 3. A flux 9 is coated onto the soluble conductor 3, and the flux 9 is housed in the space 8 which is provided in the insulation cover 4.

In addition, as disclosed in Patent Document 1, as a protection element for shortening a circuit shutoff time due to coagulation at the time of blowout of a low-melting metal member and then reducing a difference in operation time, there is provided the one in which a low-melting metal member having two stripes or a low-melting metal member forming a slit in an intra-electrode direction is provided between a pair of electrodes supplying a current to the low-melting metal member. This protection element is capable of segmenting the low-melting metal member between the electrodes in an independent state, increasing the number of blowout start points in low-melting metal member, and then, reducing and stabilizing an operation time.

PRIOR ART LITERATURE

Patent Documents

[Patent Document 1] Japanese Patent Application Laid-open No. 2004-214032

SUMMARY OF THE INVENTION

Problems to be Solved by the Invention

In a protection element in which a flux is provided at a soluble conductor of a low-melting metal, the flux functions as an activator for preventing oxidization of a soluble conductor and for causing a blowout exerted by an overcurrent or an overvoltage, and a retention state of the flux influences an operation speed. In particular, in a process of manufacturing an electronic device or in a process of waste management, in order to mitigate an environmental burden, in a case where a halogen-free flux which does not contain a halogen component, such as boron (Br), is used, since the flux of this type is low in degree of activity, the state of the flux greatly influences a blowout speed or stability of the soluble conductor.

That is, as shown in FIG. 14, in the insulation cover 4, the flux 9 on the soluble conductor 3 is not stably retained at a central part of the space 8, and may be unevenly distributed at the left or right. In such a case, there emerges a circumstance that: a fused metal of the soluble conductor 3 is likely to flow in a location in which the flux 9 could be retained; and the soluble conductor 3 is hardly fused at a portion at which the flux 9 is insufficient, and there is a problem that time taken for reliable blowout is extended.

Further, as in the invention set forth in Patent Document 1, in a case where a low-melting metal member having two or more stripes or a low-melting metal member forming a slit has been formed as well, there arises a problem exerted by a flux having its low degree of activity such as the abovementioned halogen-free flux, and further forming of a slit or the like requires a special molding die on the manufacture of a protection element, resulting in higher manufacturing costs.

The present invention has been made in view of the above-described background art, and it is an object of the present invention to provide a protection element which is capable of stably retaining a flux on a soluble conductor at a predetermined position, enabling a speedy and precise blowout of the soluble conductor in the event of an abnormality.

Means for Solving the Problem

The present invention is directed to a protection element including: a soluble conductor which is disposed on an insulation baseboard and is connected to a power supply path of a device targeted to be protected, to cause a blowout due to a predetermined abnormal electric power; an insulation cover which is mounted on the baseboard with the soluble conductor being covered via a predetermined space; and a flux which is applied to a surface of the soluble conductor and is positioned in the space, the protection element being adapted for, in case that the abnormal electric power is supplied to the device targeted to be protected, allowing the soluble conductor to cause a blowout and then to shut off a current path of the conductor, the protection element comprising a stepped portion which is formed on an interior face of the insulation cover in opposite to the soluble conductor, for retaining the flux at a predetermined position in the space in contact with the flux, wherein a hole portion retaining the flux is formed at the soluble conductor.

The hole portion of the soluble conductor is a through hole formed at the center part of the soluble conductor. The stepped portion is made of a protrusive stripe portion which is formed on the interior face of the insulation cover and which is provided in face-to-face opposite to the hole portion of the soluble conductor. In addition, on a peripheral surface of the hole portion at the center part of the soluble conductor, a protrusive portion may be formed along a circumferential edge part.

Further, a relatively small hole portion other than the center part of the soluble conductor may be formed at the soluble conductor, and a number of small hole portions may be formed at the soluble conductor. Further, an opening portion which is a through hole may be formed inside of the stepped portion of the insulation cover.

Effect of the Invention

According to a protection element of the present invention, a stepped portion for retaining a flux is provided inside of an insulation cover, and a hole portion is provided at a soluble conductor, thus enabling the flux to be stably retained at a predetermined position of the soluble conductor. In this manner, in particular, in a case where a flux with its low degree of activity (such as a halogen-free flux) is used as well, it is possible to prevent uneven distribution of the degree of activity due to bias of a flux retention state after applying the flux. Further, in blowout operation of a soluble conductor, in particular, in heating operation characteristics of low electric power, an operational distortion can be remarkably reduced. Moreover, a protection element with its small environmental burden can be provided by employing a halogen-free flux. A fusion volume can be reduced while a conventional foil size of a soluble conductor is maintained, enabling an easier blowout.

By forming a small hole portion other than a flux retaining portion of a soluble conductor, a flux can be reliably retained at a peripheral portion of the soluble conductor, and a blowout volume is also reduced, thus enabling a reliable blowout for a short period of time in the event of an abnormality.

By forming a protrusive portion around a hole portion of a soluble conductor, a flux can be retained further reliably, contributing to stabilization of blowout characteristics.

By providing an opening portion at an insulation cover, it becomes possible to visually check the inside of a flux for appearance.

BEST MODES FOR CARRYING OUT THE INVENTION

Figure 1:
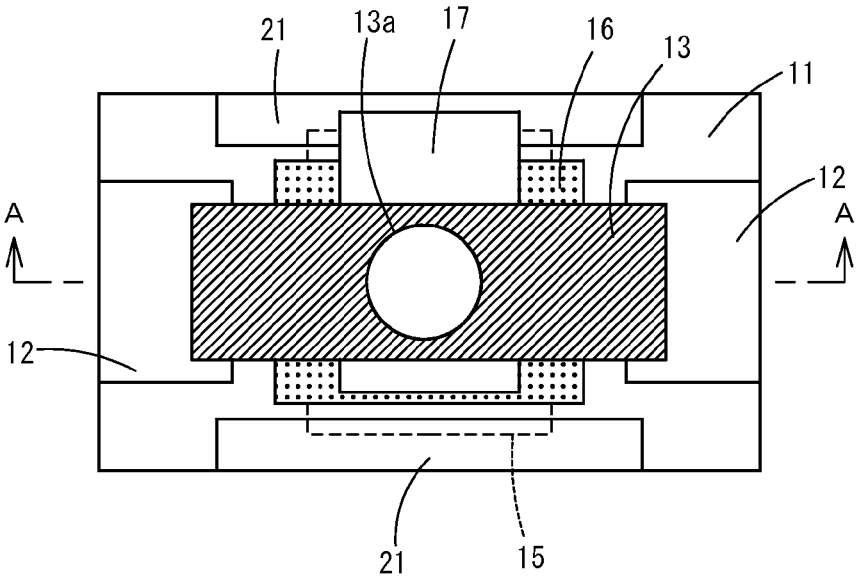
FIG. 1 It is a plan view of a state in which an insulation cover is removed from a protection element according to a first embodiment of the present invention.

Hereinafter, a first embodiment of a protection element of the present invention will be described with reference to FIGS. 1 to 5. A protection element 10 of the embodiment has a pair of electrodes 12 which is formed on both ends of a top face of an insulation baseboard 11, and the other pair of electrodes 21 is provided at opposite edge parts which are orthogonal to the pair of electrodes 12. A heating element 15 made of a resistor is connected between the electrodes 21. At the heating element 15, a conductor layer 17 which is connected to one electrode 21 is laminated via an insulation layer 16. A center part of a soluble conductor 13 which is a fuse made of a low-melting metal connected to the pair of electrodes 12 is connected to the conductor layer 17. In addition, on the baseboard 11, an insulation cover 14 as an insulation member is provided in face-to-face opposite to the soluble conductor 13.

As a material for the baseboard 11, any kind of material may be employed as long as it has an insulation property, and for example, an insulation board employed for a printed wiring board, such as a ceramic board or a glass epoxy board, is preferable. In addition, a glass board, a resin board, or an insulation processing metal board or the like can be employed for appropriate usage, whereas a ceramic board with its superior heat resistance and its good thermal conductivity is further preferable.

As the electrodes 12, 21 and the conductor layer 17, there can be used a metal foil such as copper or a conductor material whose surface is plated with Ag—Pt, Au, or the like. In addition, there may be employed a conductor layer or an electrode obtained by coating and firing an electrically conductive paste, such as an Ag paste, or alternatively, a metal thin-film structure obtained by evaporation or the like.

Figure 3:
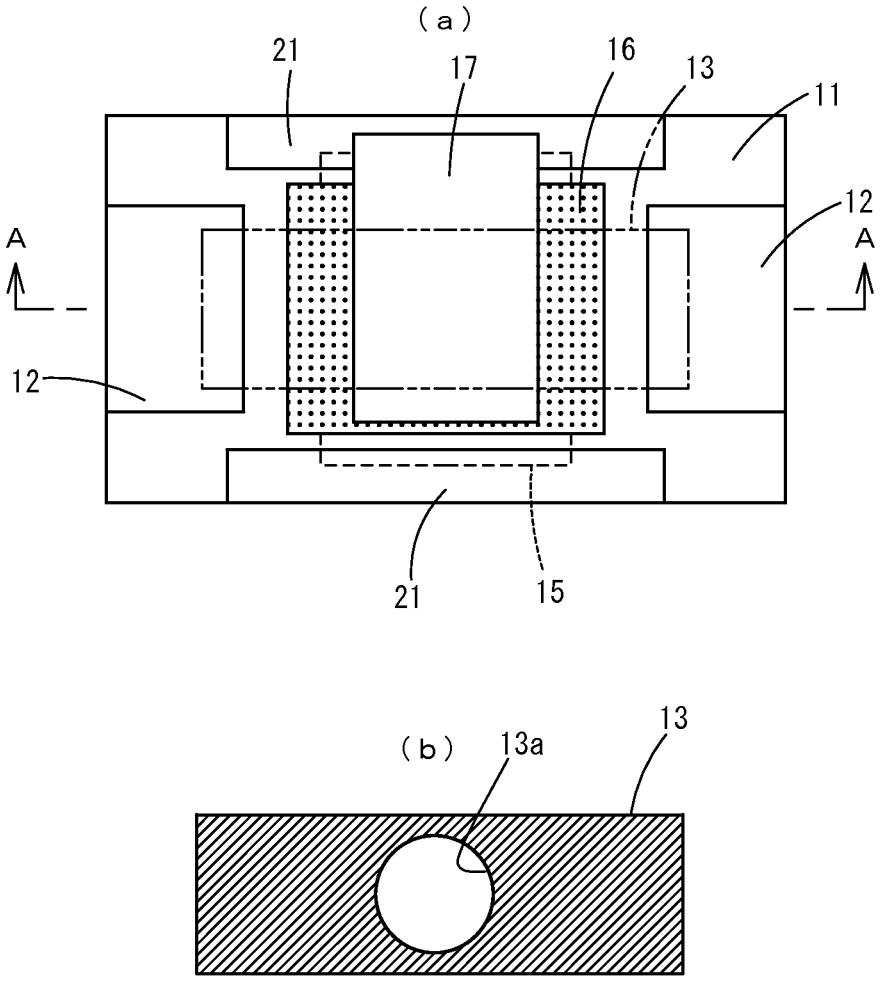
FIG. 3 It is a plan view (a) before mounting a soluble conductor on the protection element according to the first embodiment of the present invention and it is a plan view (b) of the soluble conductor.
Figure 4:
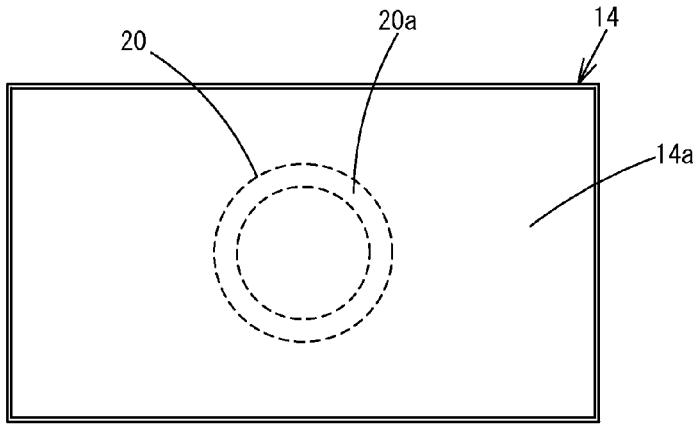
FIG. 4 It is a plan view of an insulation cover of the protection element according to the first embodiment of the present invention.

At the soluble conductor 13, a hole portion 13*a* made of an annular through hole formed at a center part thereof is formed. The hole portion 13*a*, as shown in FIG. 3, is formed in a circular shape, and is face-to-face opposed to be positioned concentrically with a protrusive stripe portion 20 of an insulation cover 14 to be described later. A low-melting metal foil of the soluble conductor 13 may be employed as long as it is fused at a predetermined electric power, and a variety of low-melting metals which are publicly known can be used as materials for fuse. For example, a BiSnPb alloy, a BiPbSn alloy, a BiPb alloy, a BiSn alloy, a SnPb alloy, a SnAg alloy, a PbIn alloy, a ZnAl alloy, an InSn alloy, a PbAgSn alloy or the like can be employed.

A resistor forming the heating element 15 is obtained by coating and firing a resistance paste made of an electrically conductive material such as ruthenium oxide or carbon black and an inorganic binder such as glass or an organic binder such as thermal setting resin. In addition, this resistor may be formed by printing and firing a thin film of ruthenium oxide or carbon black or by means of plating, evaporation, or sputtering, or alternatively, may be formed by attaching or laminating a film of these resistor materials, for example.

The insulation cover 14 that is mounted on the baseboard 11 is formed in a box shape which opens at one side face, and is put on the baseboard 11 with the predetermined space 18 being formed relative to the soluble conductor 13. As a material for the insulation cover 14, there may be an insulation material having its heat resistance which is resistive to a heat at the time of blowout of the soluble conductor 13, the insulation material having a mechanical strength which is identical to that of the protection element 10. For example, a variety of materials such as board materials employed for printed wiring boards such as glass, ceramics, plastics, or glass epoxy resin can be applied. Further, an insulation layer such as an insulation resin may be formed on a face opposite to the baseboard 11, by employing a metal plate. Preferably, a material with its mechanical strength and its high insulation property such as ceramics is preferable, since it contributes to thickness reduction of the entire protection element as well.

On an interior face 14*a* of the insulation cover 14, a low cylindrical protrusive stripe portion 20 which is provided with a concentrically circular stepped portion 20*a* is formed at a position which is opposite to the hole portion 13*a* at a center part of the soluble conductor 13. The protrusive stripe portion 20 is formed integrally with the insulation cover 14, and a projection position for the baseboard 11 is positioned on the heating element 15.

Figure 2:
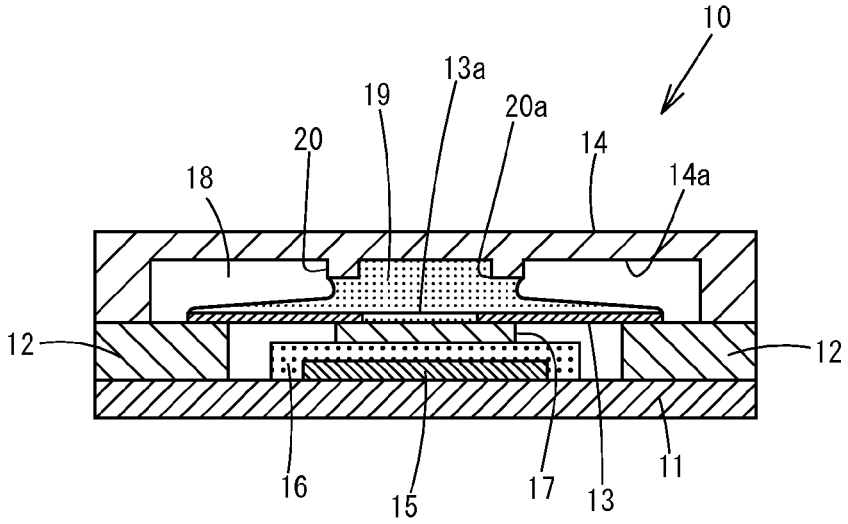
FIG. 2 It is a sectional view taken along the line A-A of FIG. 1, of a state in which the insulation cover is mounted on the protection element of FIG. 1.

On an entire surface of the soluble conductor 13, a flux 19 is provided in order to prevent oxidization of the surface. As the flux 19, a halogen-free flux which does not have a halogen element such as boron is preferable. The flux 19 is filled in the hole portion 13*a* of the soluble conductor 13; further stays at the periphery thereof, and is retained on the soluble conductor 13 by means of surface tension. Further, the flux 19 rises and is housed in the space 18 of the insulation cover 14, by means of surface tension, and as shown in FIG. 2, the housed flux 19 adheres to the protrusive stripe portion 20 that is formed on the interior face 14*a* of the insulation cover 14, and then, the resultant flux 19 is stably retained by means of the stepped portion 20*a* due to its wettability. In this manner, the flux 19 is stably retained in the space 18 of the insulation cover 14 without being displaced from the center part of the soluble conductor 13.

Here, a protrusion height from the insulation cover interior face 14*a* of the protrusive stripe portion 20 is preferable to be a height to an extent such that a surface of the flux 19 coated onto the soluble conductor 13 comes into contact and the flux 19 can be retained at the center part due to its wettability and surface tension. In addition, the protrusion height is limited to an extent such that, in respect of the fused soluble conductor 13 with a low-melting metal being fused due to abnormal electric power, a top part having spherically risen due to its surface tension just comes into contact with something. Preferably, the protrusion height is preferable to an extent such that the fused soluble conductor 13 does not come into contact with anything.

Figure 5:
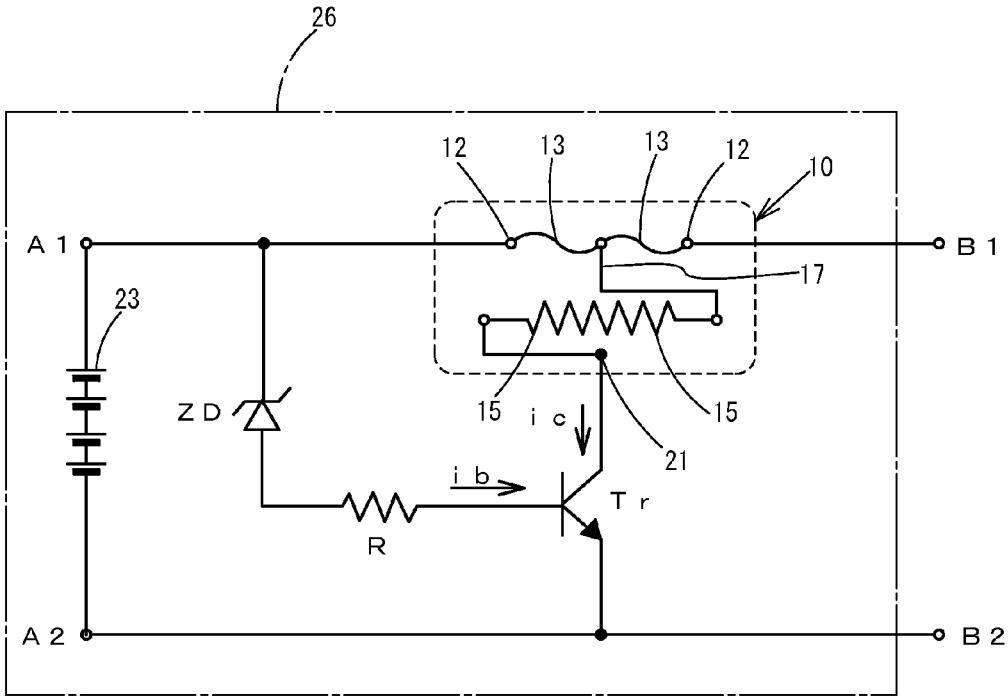
FIG. 5 It is a circuit diagram of a secondary battery device providing the protection element according to the first embodiment of the present invention.

Next, as an example of employing the protection element 10 of the embodiment in an electronic device, an overcurrent or overvoltage protection circuit 26 of a secondary battery device will be described with reference to FIG. 5. In this overcurrent or overvoltage protection circuit 26, a pair of electrodes 12 of the protection element 10 is connected in series between an output terminal A1 and an input terminal B1, one terminal of the pair of electrodes 12 of the protection element 10 is connected to the input terminal B1, and the other electrode 12 is connected to the output terminal A1. In addition, a neutral point of the soluble conductor 13 is connected to one end of the heating element 15, and one terminal of the electrode 21 is connected to the other terminal of the heating element 15. The other terminal of the heating element 15 is connected to a collector of a transistor Tr, and an emitter of the transistor Tr is connected between the other output terminal A2 and input terminal B2. Further, an anode of a Zener diode ZD is connected to a base of the transistor Tr via a resistor R, and a cathode of the Zener diode ZD is connected to the output terminal A1. The resistor R is set at a value such that when a predetermined value set to be abnormal is applied between the output terminals A1 and A2, a voltage beyond a breakdown voltage is applied to the Zener diode ZD.

Electrode terminals of the secondary battery 23 which is a device targeted to be protected, such as a lithium ion battery, for example, are connected between the output terminals A1 and A2, and electrode terminals of a device such as a battery charger, although not shown, which is to be used to be connected to the secondary battery 23, are connected to the input terminals B1 and B2.

Next, a protection operation of the protection element 10 of the embodiment will be described. In a secondary battery device such as a lithium ion battery on which the overcurrent or overvoltage protection circuit 26 of the embodiment has been mounted, if an abnormal voltage is applied to the output terminals A1 and A2 at the time of power charging thereof, an inversed voltage which is equal to or greater than a breakdown voltage is applied to the Zener diode ZD at a predetermined voltage which is set to be abnormal, and then, the Zener diode ZD is made conductive. By making the Zener diode ZD conductive, a base current ib flows into a base of a transistor TR, whereby a transistor Tr is turned on, a collector current is flows into the heating element 15, and then, the heating element 15 generates a heat. This heat is transmitted to the soluble conductor 13 of a low-melting metal on the heating element 15, the soluble conductor 13 blows out, and then, an electric conduction between the input terminal B1 and the output terminal A1 is shut off, preventing an overvoltage from being applied to the output terminals A1 and A2.

At this time, the flux 19 is retained at the center part of the soluble conductor 13, and blows out speedily and reliably at a predetermined blowout position. In addition, in case that an abnormal current flows toward the output terminal A1 as well, the soluble conductor 13 is set so as to generate a heat and then blow out due to the current.

According to the protection element 10 of the embodiment, on the interior face 14*a* of the insulation cover 14, a protrusive-shaped cylindrical protrusive stripe portion 20 is provided to be face-to-face opposed to the soluble conductor 13, and a hole portion 13*a* is formed at the center part of the soluble conductor 13 in opposite to the protrusive stripe portion 20, thus enabling the flux 19 to be stably retained at a predetermined position at the center part of the soluble conductor 13. In this manner, in particular, in a case where a flux 19 such as a halogen-free flux with its low degree of activity is used as well, it is possible to prevent uneven distribution of an action of the flux due to bias or distortion of a coating state of the flux 19, and a blowout of the soluble conductor 13 is ensured. Further, a blowout volume is reduced by the hole portion 13*a* of the soluble conductor 13, so that blowout in the event of an abnormality is performed more reliably within a short period of time.

Figure 6:
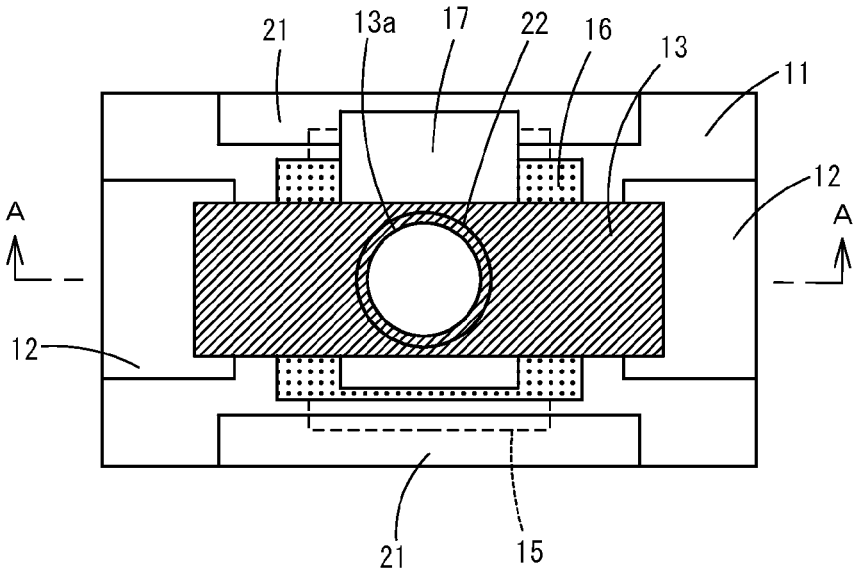
FIG. 6 It is a plan view of a state in which an insulation cover is removed from a protection element according to a second embodiment of the present invention.
Figure 7:
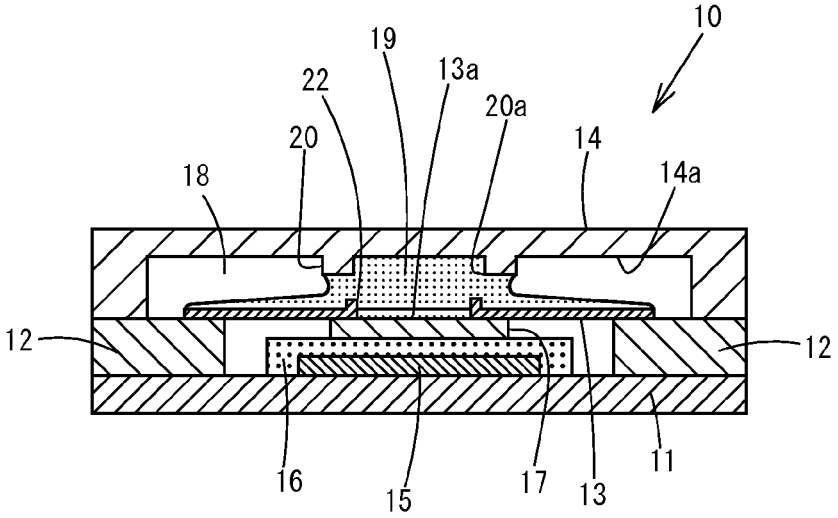
FIG. 7 It is a sectional view taken along the line A-A of FIG. 6, of a state in which the insulation cover is mounted on the protection element of FIG. 6.

Next, a second embodiment of a protection element of the present invention will be described with reference to FIGS. 6 and 7. Herein, like constituent elements in the abovementioned embodiment are designated by like reference numerals, and a duplicate description is omitted. In a protection element 10 of the embodiment, on an interior face 14*a* of an insulation cover 14, a cylindrical protrusive stripe portion 20 having a stepped portion 20*a* is provided in opposite to a soluble conductor 13, and a protrusive portion 22 is formed along a peripheral edge part of a hole portion 13*a* of the soluble conductor 13.

According to the protection element 10 of the embodiment, it becomes possible to more stably retain the flux 19 at a predetermined position by means of the protrusive portion 22, and blowout operation of the soluble conductor 13 can be performed more stably.

Figure 8:
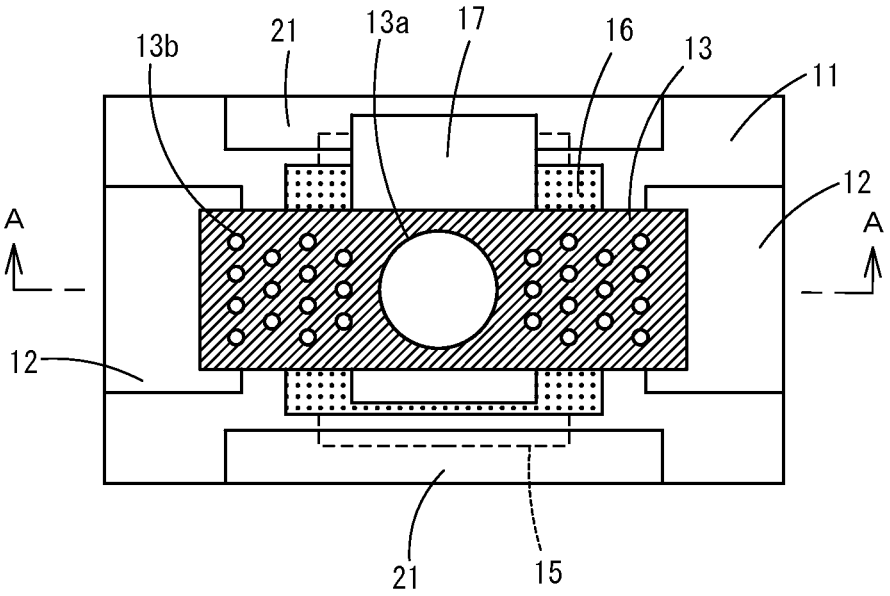
FIG. 8 It is a plan view of a state in which an insulation cover is removed from a protection element according to a third embodiment of the present invention.
Figure 9:
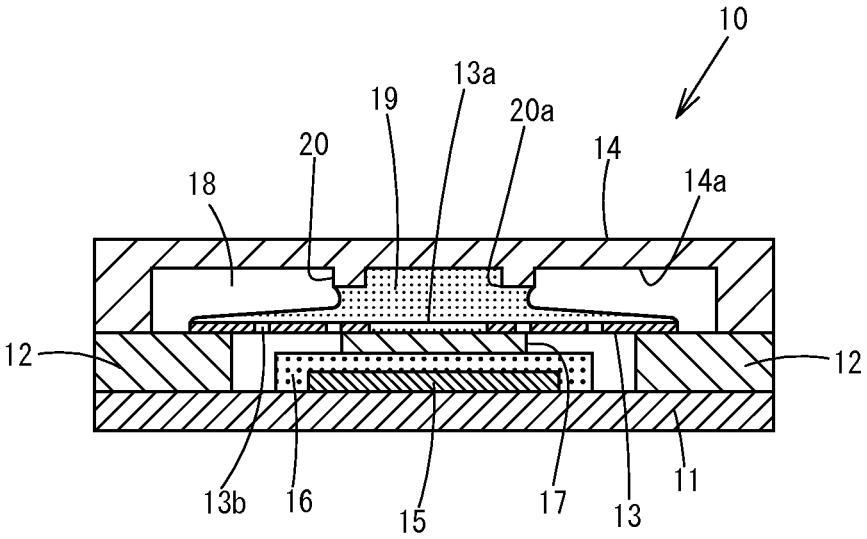
FIG. 9 It is a sectional view taken along the line A-A of FIG. 8, of a state in which the insulation cover is mounted on the protection element of FIG. 8.

Next, a third embodiment of a protection element of the present invention will be described with reference to FIGS. 8 and 9. Herein, like constituent elements in the above-described embodiments are designated by like reference numerals, and a duplicate description is omitted. According to the embodiment, a small hole portion 13*b* which is a relatively small hole portion is formed at another position as well, in addition to the protrusive portion 20 having the stepped portion 20*a* and the hole portion 13*a* at the center part of the soluble conductor 13, of the interior face 14*a* of the insulation cover 14.

According to the protection element 10 of the embodiment, a flux 19 can be stably retained at a center part by means of the hole portion 13*a*; the flux 19 is retained at a small hole portion 13*b* even at a position other than the center part of the soluble conductor 13; and blowout characteristics of the soluble conductor 13 are made more stable. The protrusive portion 22 of the second embodiment may be formed on the soluble conductor 13 of the embodiment. In this manner, the position of the flux 19 is further stabilized and then its blowout characteristics are improved.

Figure 10:
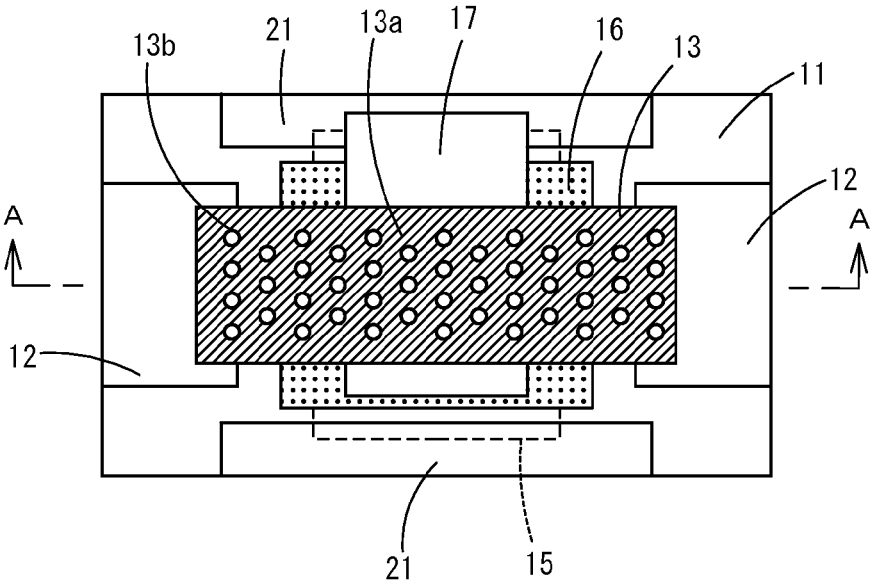
FIG. 10 It is a plan view of a state in which an insulation cover is removed from a protection element according to a fourth embodiment of the present invention.
Figure 11:
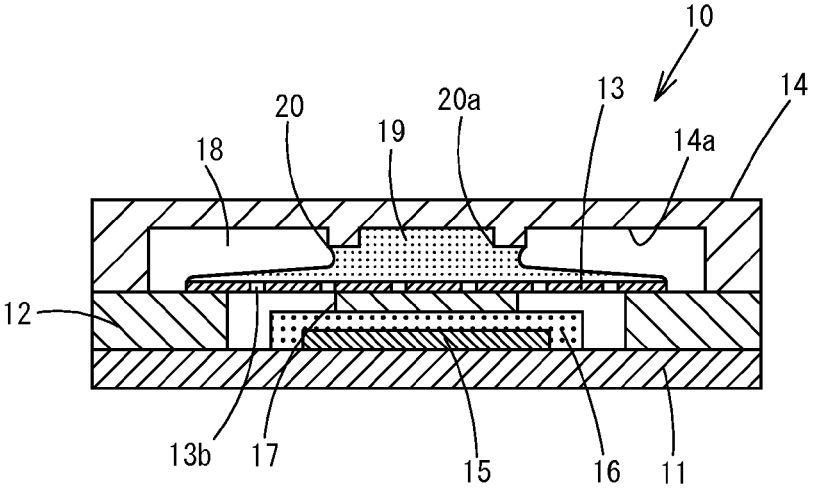
FIG. 11 It is a sectional view taken along the line A-A of FIG. 10, of a state in which the insulation cover is mounted on the protection element of FIG. 10.

Next, a fourth embodiment of a protection element of the present invention will be described with reference to FIGS. 10 and 11. Herein, like constituent elements in the above-described embodiment s are designated by like reference numerals, and a duplicate description is omitted. In the embodiment, while a protrusive stripe portion 20 having a stepped portion 20*a*, of an interior face 14*a* of an insulation cover 14 is provided, a small hole portion 13*b* which is a relatively small hole portion is formed all over the soluble conductor 13, in place of the hole portion 13*a* at the center part of the soluble conductor 13.

According to the protection element 10 of the embodiment, a flux 19 can be stably retained at a center part by means of a protrusive stripe portion 22 of the insulation cover 14 and the small hole portion 13*b* of the soluble conductor 13, and a flux 19 is retained at a peripheral part of the soluble conductor 13 as well, by means of the small hole portion 13*b* other than the center part of the soluble conductor 13, thereby stabilizing blowout characteristics.

Figure 12:
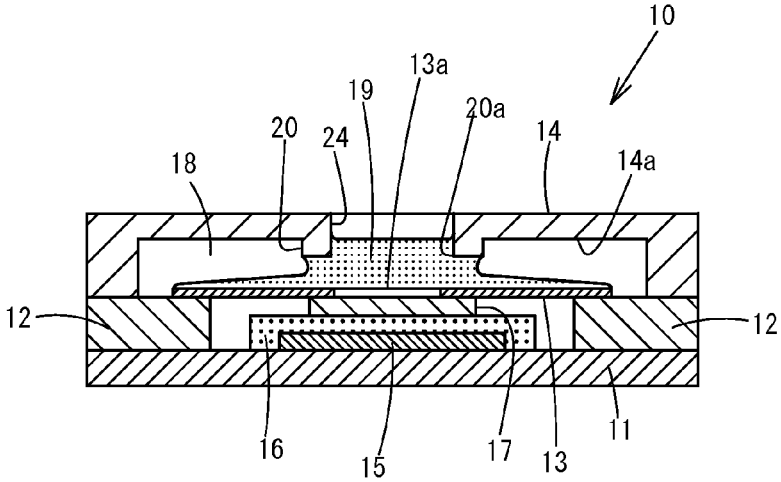
FIG. 12 It is a longitudinal cross section of a protection element according to a fifth embodiment of the present invention.
Figure 13:
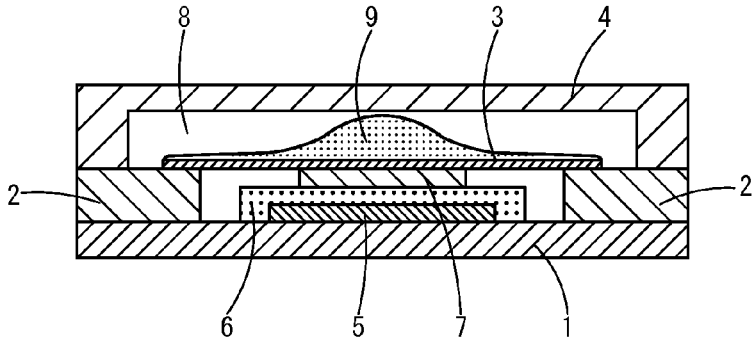
FIG. 13 It is a longitudinal cross section of a conventional protection element.
Figure 14:
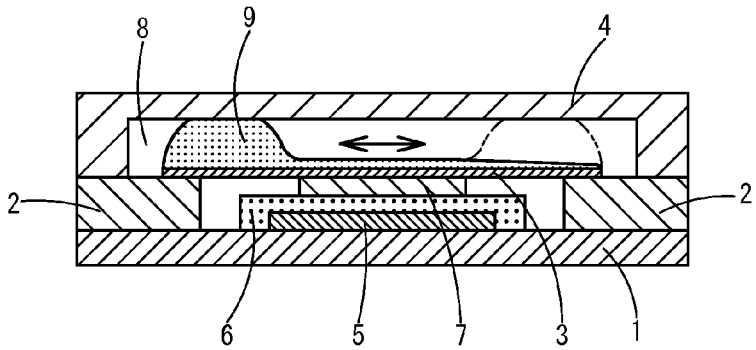
FIG. 14 It is a longitudinal cross section showing an appearance of a flux of the conventional protection element.

Next, a fifth embodiment of a protection element of the present invention will be described with reference to FIG. 12. Herein, like constituent elements in the above-described embodiments are designated by like reference numerals, and a duplicate description is omitted. In a protection element 13 of the embodiment, an opening portion 24 is provided at a center part at which a protrusive stripe portion 20 of an insulation cover 14 is positioned, together with a cylindrical-shaped protrusive stripe portion 20 having a stepped portion 20*a*, of an interior face 14*a* of the insulation cover 14.

According to the protection element 10 of the embodiment, in addition to an advantageous effect similar to that of the above-described embodiment, which is exerted by the protrusive stripe portion 20 of the opening portion 24, a retention state of a flux 19 can be visually checked with naked eyes through the opening portion 24, and product check can be made more easily and reliably. The opening portion 24 may be sealed with a transparent glass or a resin. This makes it possible to prevent the entry of dust or the like though the opening portion 24. In addition, the protrusive stripe portion 20 may not be formed by means of a stepped portion caused by the opening portion 24.

The protection element of the present invention is not limited to the above-described embodiments, and may be formed in the shapes of an insulation cover and a soluble conductor which are capable of retaining a flux at a predetermined position in a space provided in the insulation cover, irrespective of any retention mode thereof. In addition, any kind of material for the flux or insulation cover can be selected as long as it functions properly.

The invention claimed is:

1. A protection element for protecting a device to be protected, the protection element comprising:

an insulation baseboard;

a pair of electrodes provided at both ends of a top face of the insulation baseboard;

a low-melting metal conductor which is disposed on the insulation baseboard, and which is adapted to be connected to a power supply path of the device to be protected, wherein the low-melting metal conductor is adapted to cause a blowout by means of a predetermined abnormal electric power, and the protection element is adapted to allow the low-melting metal conductor to blow out and shut off a current path thereof if the abnormal electric power is supplied to the device to be protected;

an insulation cover which is mounted on the baseboard so as to cover the low-melting metal conductor with a predetermined space therebetween;

a flux which is applied to a surface of the low-melting metal conductor and is positioned in the space;

a stepped portion which is formed on a center part of an interior face of the insulation cover opposite to the low-melting metal conductor, for retaining the flux at a predetermined position in the space in direct physical contact with the flux, wherein the flux is retained at the predetermined position in the space in direct physical contact with the stepped portion due to its wettability and surface tension, wherein the insulation cover mounted on the insulation baseboard is formed in a box shape which opens at one side face, wherein a hole portion retaining the flux is formed in the low-melting metal conductor, the hole portion being a through hole formed at a center part of the low-melting metal conductor, the flux being positioned on the low-melting metal conductor so as to be in direct physical contact with at least a peripheral surface of the hole portion so as to be retained at the hole portion due to its wettability and surface tension, and wherein the stepped portion is concentrically circular and comprises a cylindrical protrusive stripe portion which is formed on the interior face of the insulation cover integrally therewith and is provided face-to-face opposite to the hole portion of the low-melting metal conductor.

2. The protection element according to claim 1, wherein a protrusive portion is formed along a peripheral edge part on the peripheral surface of the hole portion at the center part of the low-melting metal conductor.

3. The protection element according to claim 1, wherein a relatively small hole portion is formed in the low-melting metal conductor at a portion other than the center part of the low-melting metal conductor.

4. The protection element according to claim 1, wherein a number of small hole portions are formed in the low-melting metal conductor.

5. The protection element according to claim 1, wherein an opening portion which is a through hole is formed inside of the stepped portion of the insulation cover.

6. The protection element according to claim 1, wherein a protrusion height of the protrusive stripe portion from the interior face of the insulation cover is set such that a surface of the flux coated onto the low-melting metal conductor comes into direct physical contact with the protrusive stripe portion and such that the flux is retained at the center part of the low-melting metal conductor due to its wettability and surface tension.

* * * * *